US009482026B2

(12) United States Patent
Ampoyo

(10) Patent No.: US 9,482,026 B2
(45) Date of Patent: Nov. 1, 2016

(54) FOLDABLE FRAME FOR A PORTABLE CANOPY

(71) Applicant: Geoffrey Angeles Ampoyo, Alexandria, VA (US)

(72) Inventor: Geoffrey Angeles Ampoyo, Alexandria, VA (US)

( * ) Notice: Subject to any disclaimer, the term of this patent is extended or adjusted under 35 U.S.C. 154(b) by 0 days.

(21) Appl. No.: 14/188,798

(22) Filed: Feb. 25, 2014

(65) Prior Publication Data

US 2014/0261602 A1 Sep. 18, 2014

Related U.S. Application Data

(60) Provisional application No. 61/851,662, filed on Mar. 12, 2013.

(51) Int. Cl.
*E04H 15/50* (2006.01)

(52) U.S. Cl.
CPC ..... *E04H 15/50* (2013.01); *E04H 15/505* (2013.01)

(58) Field of Classification Search
CPC ..... E04H 15/50; E04H 15/505
USPC ..... 135/131, 145, 88.06
See application file for complete search history.

(56) References Cited

U.S. PATENT DOCUMENTS 1,846,011 A * 2/1932 Adams ..... 135/158
4,605,030 A 8/1986 Johnson
4,641,676 A 2/1987 Lynch
4,655,236 A * 4/1987 Dorame et al. ..... 135/88.06
4,779,635 A 10/1988 Lynch
4,947,884 A 8/1990 Lynch
5,244,001 A 9/1993 Lynch
5,421,356 A 6/1995 Lynch
5,794,640 A 8/1998 Jang
6,089,246 A * 7/2000 Barnes ..... A45B 11/00 135/117
6,141,934 A * 11/2000 Zeigler ..... 52/646
6,206,020 B1 3/2001 Lynch
6,439,251 B2 * 8/2002 Carter ..... 135/158
6,591,849 B1 7/2003 Swetish et al.
6,718,995 B2 4/2004 Dotterweich
7,055,538 B2 * 6/2006 Deng ..... 135/131
7,367,348 B2 5/2008 Tsai
7,546,844 B2 * 6/2009 Al-Mutairi ..... 135/88.06
7,703,469 B2 4/2010 Danziger
7,798,162 B2 9/2010 Sy-Facunda
7,836,908 B2 11/2010 Sy-Facunda
7,946,306 B2 5/2011 Ampoyo
8,544,489 B2 10/2013 Choi
8,616,226 B2 12/2013 Ma
2002/0092555 A1 7/2002 Tsai
2002/0108647 A1 8/2002 Chen (Continued)

*Primary Examiner* — David R Dunn
*Assistant Examiner* — Danielle Jackson
(74) *Attorney, Agent, or Firm* — Shlesinger, Arkwright & Garvey LLP

(57) ABSTRACT

A foldable frame for a portable canopy, comprises first, second, third and fourth posts. The posts are extendable and retractable in length and defines a geometric footprint on the ground. At least one arm is operably attached to and between adjacent posts of the first, second, third and fourth posts, the at least one arm forming a main frame within the geometric footprint. At least another arm extends outwardly from each of the posts to form at least first and second extension frames extending beyond the geometric footprint. The foldable frame includes a deployed position wherein the posts are extended and the at least one arm is transverse to the respective posts; and a folded position wherein the posts are retracted and bunched together with the at least one arm and oriented in a general same direction.

20 Claims, 16 Drawing Sheets

(56) References Cited

U.S. PATENT DOCUMENTS

2004/0144413 A1* 7/2004 Matthews et al. ..... 135/131
2007/0051397 A1* 3/2007 Choi ..... 135/131
2008/0128011 A1* 6/2008 Carter ..... 135/122
2009/0314323 A1 12/2009 Park
2010/0051078 A1 3/2010 Sy-Facunda
2011/0168219 A1* 7/2011 Griffith ..... A45B 11/00 135/88.06
2011/0308559 A1* 12/2011 Ma et al. ..... 135/122

* cited by examiner

FIG. 29
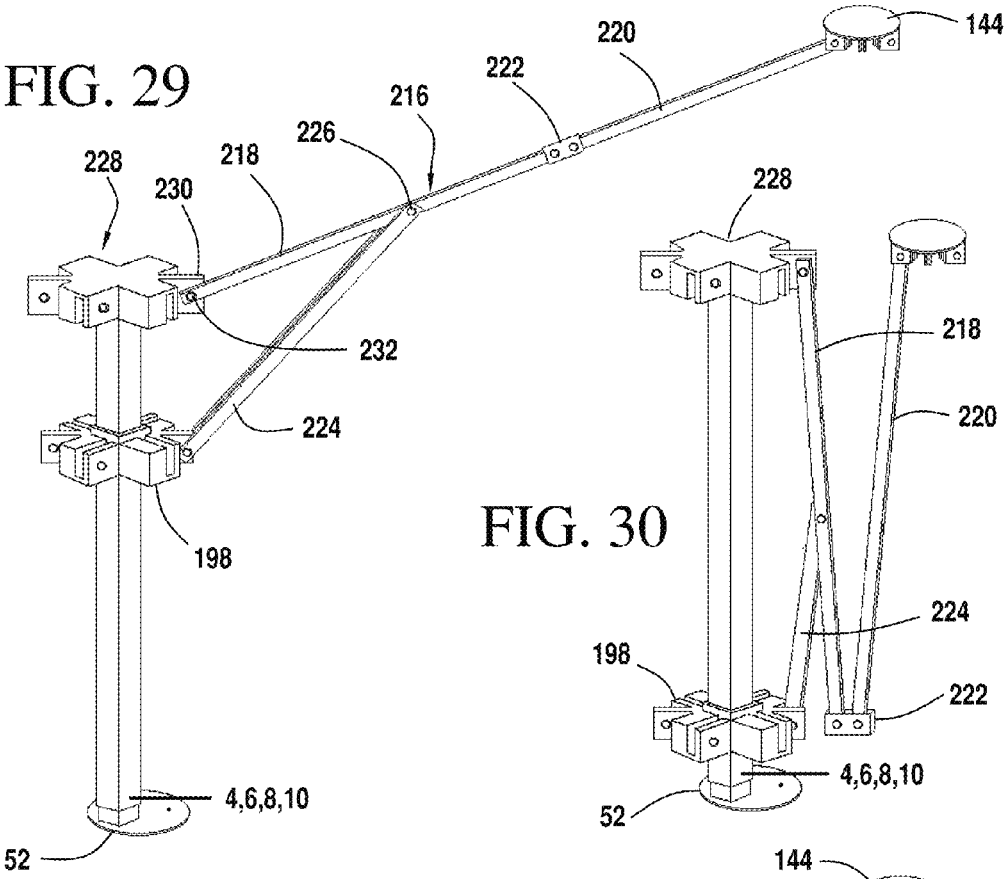
FIG. 30
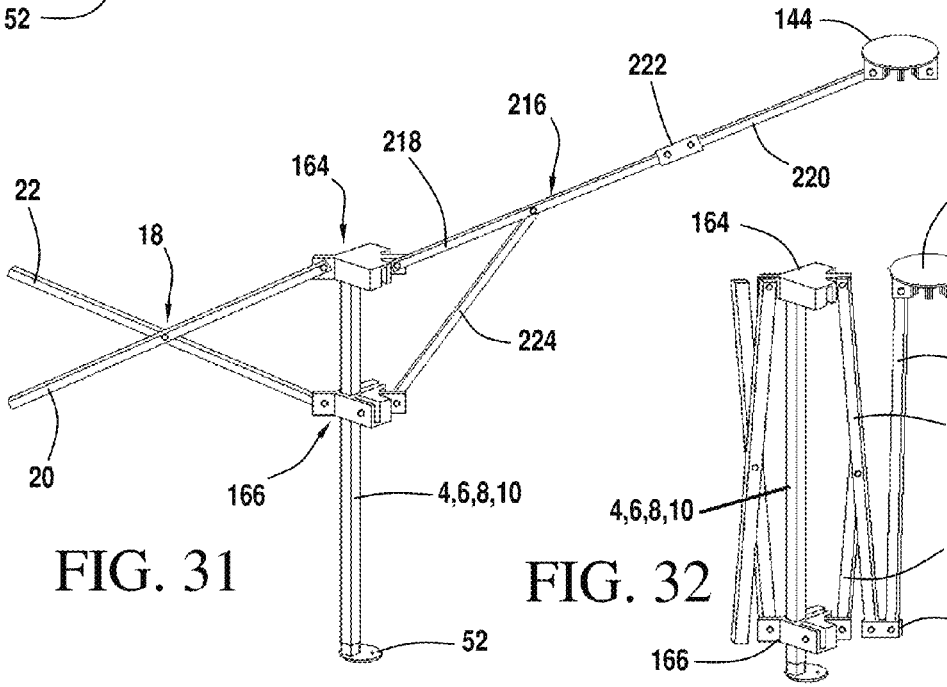
FIG. 31
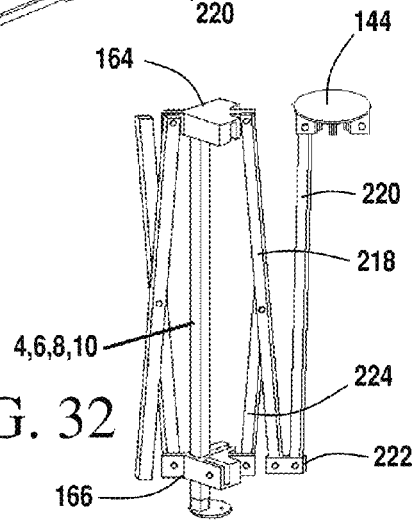
FIG. 32

FOLDABLE FRAME FOR A PORTABLE CANOPY

FIELD OF THE INVENTION

The present invention is generally to a foldable portable frame for a portable canopy and in particular, to a foldable portable frame for a canopy that folds to a compact portable package.

SUMMARY OF THE INVENTION

The present invention provides a foldable frame for a portable canopy, comprising first, second, third and fourth posts for being supported vertically on the ground. The posts are extendable and retractable in length and defines a geometric footprint on the ground. At least one arm is operably attached to and between adjacent posts of the first, second, third and fourth posts, the at least one arm forming a main frame within the geometric footprint. At least another arm extends outwardly from each of the posts to form at least first and second extension frames extending beyond the geometric footprint, the main frame and the at least first and second extension frames for supporting a cover of the portable canopy. The foldable frame includes a deployed position wherein the posts are extended and the at least one arm is transverse to the respective posts; and a folded position wherein the posts are retracted and bunched together with the at least one arm and oriented in a general same direction.

BRIEF DESCRIPTION OF THE DRAWINGS

FIG. 29 is a fragmentary perspective view of another embodiment of the supporting arm for the raised cap used in foldable frames of FIGS. 14 and 19.

FIG. 30 is perspective view showing the supporting arm of FIG. 29 in the folded position.

FIG. 31 is fragmentary perspective view of the foldable frame of FIG. 19 showing the supporting arm of FIG. 29.

FIG. 32 is perspective view showing the supporting arm of FIG. 31 and the extension frame in the folded position.

DETAILED DESCRIPTION OF THE PREFERRED EMBODIMENT

Figure 1:
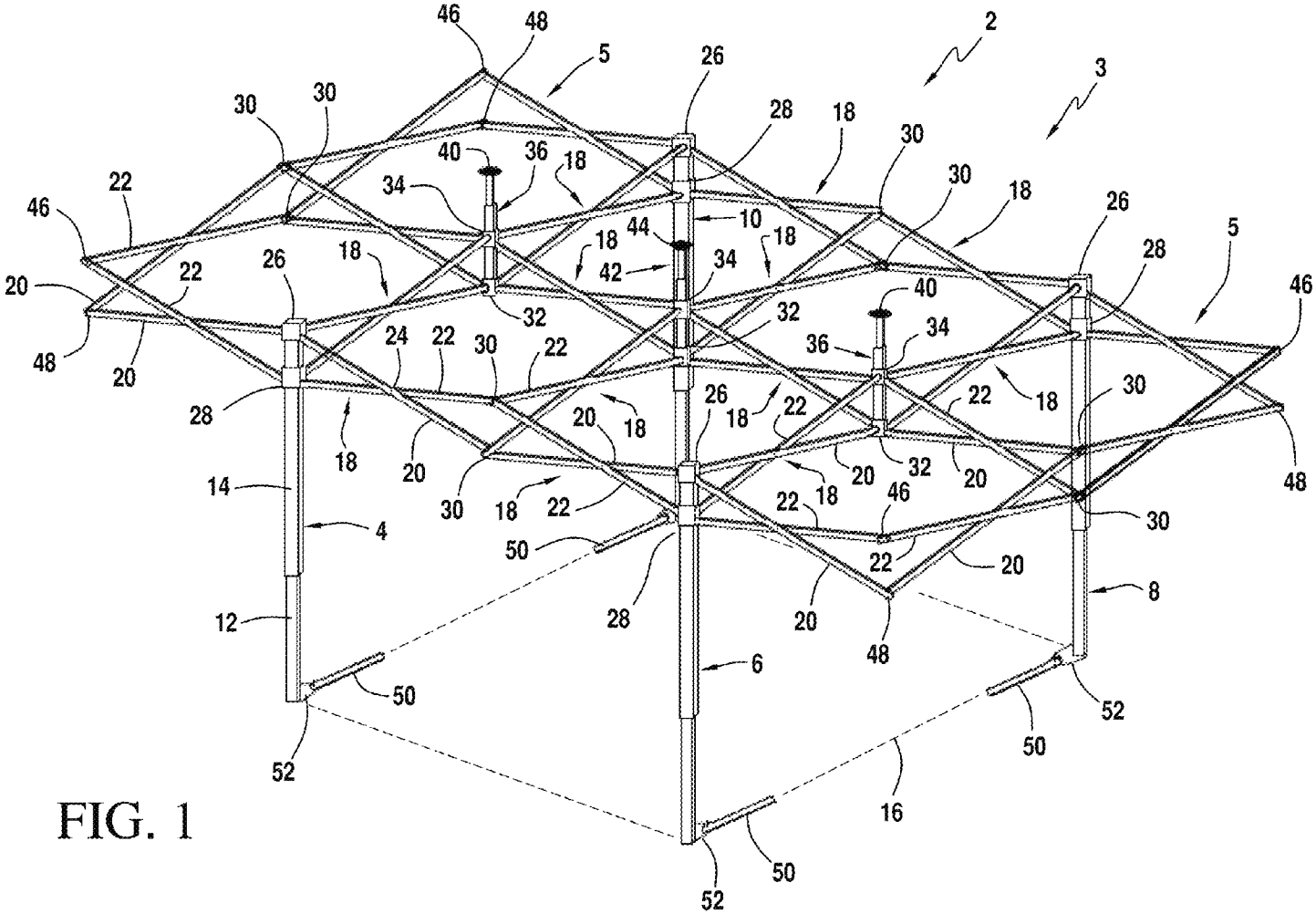
FIG. 1 is a perspective view of a foldable frame for supporting a canopy made in accordance with the present invention.

Referring to FIG. 1, a foldable frame 2 for a portable canopy made in accordance with the present invention is disclosed. The frame 2 includes vertical posts 4, 6, 8 and 10 that are supported on the ground, such as dirt, grass, gravel, concrete or asphalt pavement. Each of the posts 4-10 is telescoping, with an inner tubular member 12 being telescopingly received into an outer tubular member 14, whereby the posts may be axially extended and retracted for extending or shortening the length of the posts. The posts 4-10 are locked in the desired length with standard means, such as a removable pin radially disposed through the overlapping portions of the tubular members 12 and 14 in cooperating holes. The posts 4-10 define the vertices of a closed geometrical footprint 16 on the ground, such as a rectangle as shown. The posts 4 and 6 substantially lay on one vertical plane and the posts 8 and 10 on another vertical plane where the two planes are spaced from each other. Preferably, the geometrical footprint 16 is rectangular and the two planes are parallel.

The foldable frame 2 includes a main foldable frame 3 disposed over the geometric footprint 16 and foldable extension frames 5 that extend the foldable frame 3 on opposite sides of the foldable frame 3.

The main foldable frame 3 comprises a plurality of x-shaped foldable arms 18 connecting the posts 6-10 to each other and supporting the posts 4-10 in the vertical position. Each of the arms 18 includes a longitudinal member 20 pivotably connected to another longitudinal member 22 at pivot 24, similar to a pair of scissors. One end of the member 20 is pivotably connected to a fixed bracket 26 and one end of the member 22 to a slidable bracket 28 on the respective post. Between the posts 4 and 6 and the posts 8 and 10, the opposite ends of the members 20 and 22 are pivotably connected to each other with respective brackets 30. Between the posts 6 and 8, and 4 and 10, the opposite end of the members 20 and 22 are pivotably attached to respective fixed brackets 32 and slidable brackets 34. The longitudinal members 20 and 22 form a series of X-shapes from post to post.

Intermediate floating posts 36 interconnect the foldable arms 18 between the posts 6 and 8 and the posts 4 and 10 via the brackets 32 and 34. The bracket 32 is fixed to a bottom end of the respective floating post 36 and the slidable bracket 34 is slidable along the outer surface of the respective floating post 36. The posts 36 include a respective top cap 40 that rises above the posts 4-10.

Another floating post 42, constructed the same way as the floating posts 34, is disposed interiorly of the geometric footprint 16 and includes a top cap 44 that rises above the posts 4-10. X-shaped arms 18 connected to brackets 32 and 34 support the floating post 42 via the other arms 18 and the other floating posts 36. The caps 40 and 44 are preferably positioned at the same level to define a roof ridge when the roof cover is installed.

Two foldable extension frames 5 are provided, one at the front end of the main frame 3 and one at the rear end. The frames 5 extend beyond the boundary of the geometric footprint 16, extending the length of the main frame 3 beyond the posts 4-10 in one direction.

Each of the foldable extension frames 5 is made up of the same x-shaped arms 18 that make up the main frame 3. Each of the foldable extension frame 5 is attached to the main frame 3 via the brackets 26 and 28 at the posts and brackets 32 and 34 at the intermediate portion of the front or rear side of the main frame 3. The outlying x-shaped arms 18 are interconnected to each other by brackets 30, 32 and 46, 48. These brackets will be discussed in detail below.

A tire bar 50 is pivotably connected to a base 52 attached to the bottom of each of the posts 4-10. The tire bar 50 is pivoted to properly position them under the tires of a car when the car is parked under the canopy.

Figure 2:
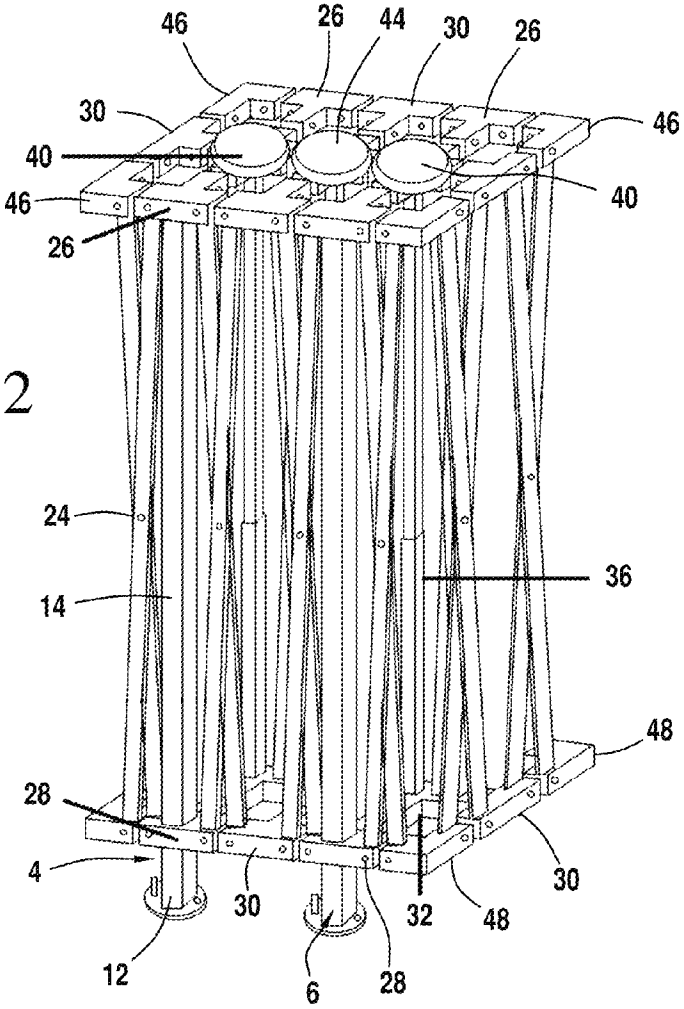
FIG. 2 is perspective view of the foldable frame of FIG. 1 shown in the folded position.

Referring to FIG. 2, the foldable frame 2 is shown folded to a compact configuration for storage when not in use. The posts 4-10 (posts 4 and 6 are visible) have been retracted to reduce their lengths by sliding the tubular members 12 into the tubular member 14. The members 20 and 22 that make up each x-shaped arm 18 are advantageously of the same length so that the frame 2 when folded becomes a compact rectangular bundle. The posts 4-10 and the longitudinal arms 20 and 22 are closer together and oriented in a general same direction when folded. The lower slidable brackets 28 are further apart from the upper fixed brackets 26. The pivots 24 that join the members 20 and 22 together are advantageously disposed at the center of each of the members 20 and 22. The longitudinal members 20 and 22 are preferably of the same length. The outer tubular member 14 of each post is advantageously longer than the length of the longitudinal arms 20 and 22 so that when the lower slidable bracket 28 slides down the outer tubular member 14 during folding, the bracket 28 will not reach the end of the tubular member 14 for smoother folding and unfolding actions.

Figure 3:
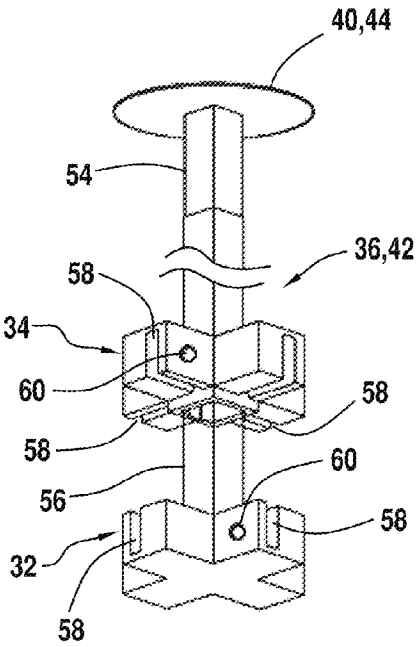
FIG. 3 is a perspective view of a floating post with an upper slidable bracket and a lower fixed bracket used in the foldable frame shown in FIG. 1.

Referring to FIG. 3, each of the floating posts 36 and 42 are constructed similar to the posts 4-10 and includes a tubular member 54 that telescopes into a tubular member 56. The posts 36 and 42 may be seen as the inverted versions of the posts 4-10 suspended in air. The total length of the post 36, 42 when retracted is preferably about the length of the members 20 and 22 so that when the frame 2 is folded, the bracket 34 can slide up the post 36, 42 as the member 22, which is pivotably attached to the bracket 34, and the member 20, which is pivotably attached to the bracket 32, are folded onto each other. The bracket 32 is fixed to the bottom of the tubular member 56 while the bracket 34 is slidable on the outside surface of the tubular members 56 and 54. Standard means, such as a removable pin radially disposed in aligned holes in overlapping portions of the tubular members (see, for example, FIG. 18) are used to lock the tubular members 54 and 56 together during use or when folded. Further, standard means, such as a removable pin radially disposed in radial holes in the tubular member 56 below the bracket 34 is used to stop the sliding bracket 34 from sliding downwardly when deployed.

The bracket 32 has four slots 58 oriented 90° to each other that receive the end portions of the members 20 and allow pivotal motion about respective pins 60. Similarly, the bracket 34 has four slots 58 oriented 90° to each other that receive the end portions of the members 22 and allow pivotal motion about the respective pins 60.

Figure 4:
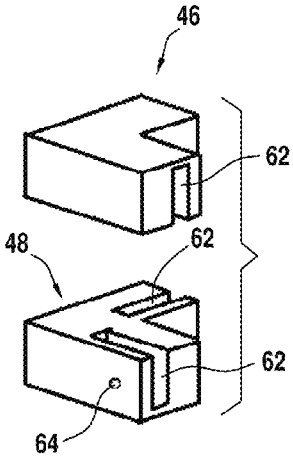
FIGS. 4-6 are perspective views of various brackets used in the foldable frame shown in FIG. 1.

Referring to FIG. 4, the brackets 46 and 48 are shown in detail. The brackets 46 and 48 are similar to each other. The bracket 48 includes two slots 62 that are oriented 90° to each other. The end portions of members 20 are pivotably received within the respective slots 62 and held pivotably inside by respective pins 64. Similarly, the bracket 46 includes similar slots 62 that received in pivotal motion the end portions of the members 22. Pins 64 (not visible) pivotably hold the members 22 within the slots 62.

Figure 5:
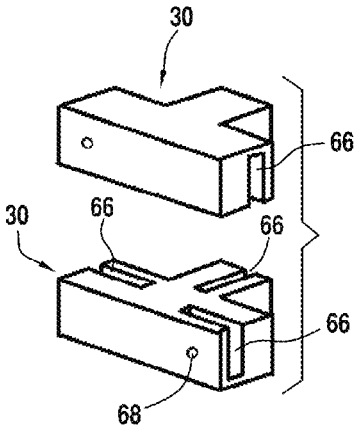

Referring to FIG. 5, the brackets 30 are shown in detail. The brackets 30 are identical to each other. The lower bracket 30 includes three slots 66 that are oriented 90° to each other. The end portions of members 22 are pivotably received within the respective slots 66 and held pivotably inside by respective pins 68 in the lower bracket 30. Similarly, the upper bracket 30 includes similar slots 66 that receive in pivotal motion the end portions of the members 20. Pins 68 (not visible) pivotably hold the members 22 within the slots 62.

Figure 6:
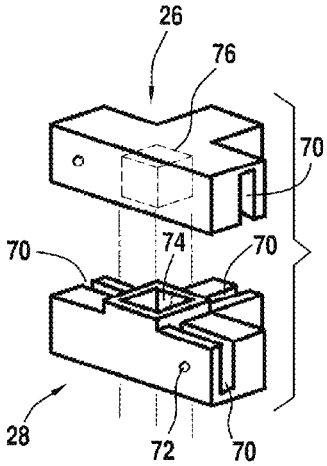

Referring to FIG. 6, the brackets 26 and 28 are shown in detail. The lower bracket 28 includes three slots 70 that are oriented 90° to each other. The end portions of members 22 are pivotably received within the respective slots 70 and held pivotably inside by respective pins 72. An opening 74 is adapted to slidably receive therethrough the tubular member 14 when the frame 2 is being folded. The opening 74 is preferably of the same cross-sectional shape as the tubular member 14, such as square as shown. The bracket 26 includes similar slots 70 that receive in pivotal motion the end portions of the members 20. Pins 68 (not visible) pivotably hold the members 20 within the slots 70. The top end portion of the tubular member 14 fixed inside a recess 76. Standard means, such as a removable pin radially disposed in radial holes in the tubular member 14 below the bracket 28 is used to stop the sliding bracket 28 from sliding downwardly when deployed.

Figure 7:
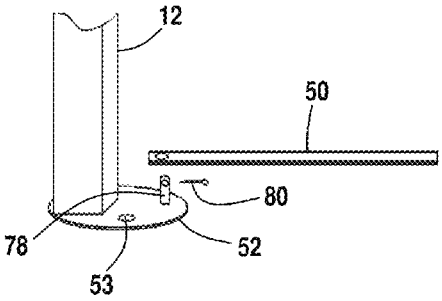
FIG. 7 is a fragmentary perspective view of a bottom end portion of the post used in the foldable frame of FIG. 1, showing a base with a removable tire bar.

Referring to FIG. 7, the base 52 at the bottom of each post 4-10 is shown in detail. The base 52 includes a pivot 78 to which the tire bar 50 is pivotably attached. A removable pin 80 secures the tire bar in place during use. The tire bar 50 is removed from the pivot 78 when the frame 2 is folded. A hole 53 through the base 52 may be used for driving a stake to the ground to secure the post 12 to the ground.

Figure 8:
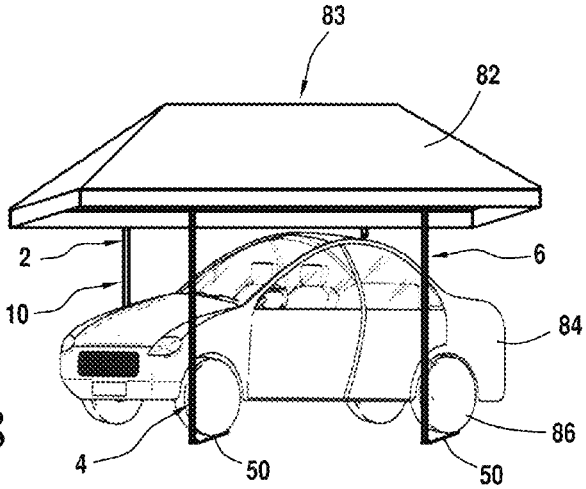
FIG. 8 is perspective view of the foldable frame of FIG. 1 supporting a canopy for use as a portable carport with the tires of the vehicle bearing down on the tire bars to secure the foldable frame in place for security.

Referring to FIG. 8, the foldable frame 2 with a fabric cover 82 is shown in the deployed position for use as a portable canopy 83 for a vehicle 84. The tire bars 50 are advantageously positioned underneath the respective tires 86 of the vehicle to keep the portable canopy in place. The extension frames 5 at the front and rear advantageously provide an extension beyond the posts 4-10 to provide additional cover for the vehicle at the front and rear portions.

Figure 9:
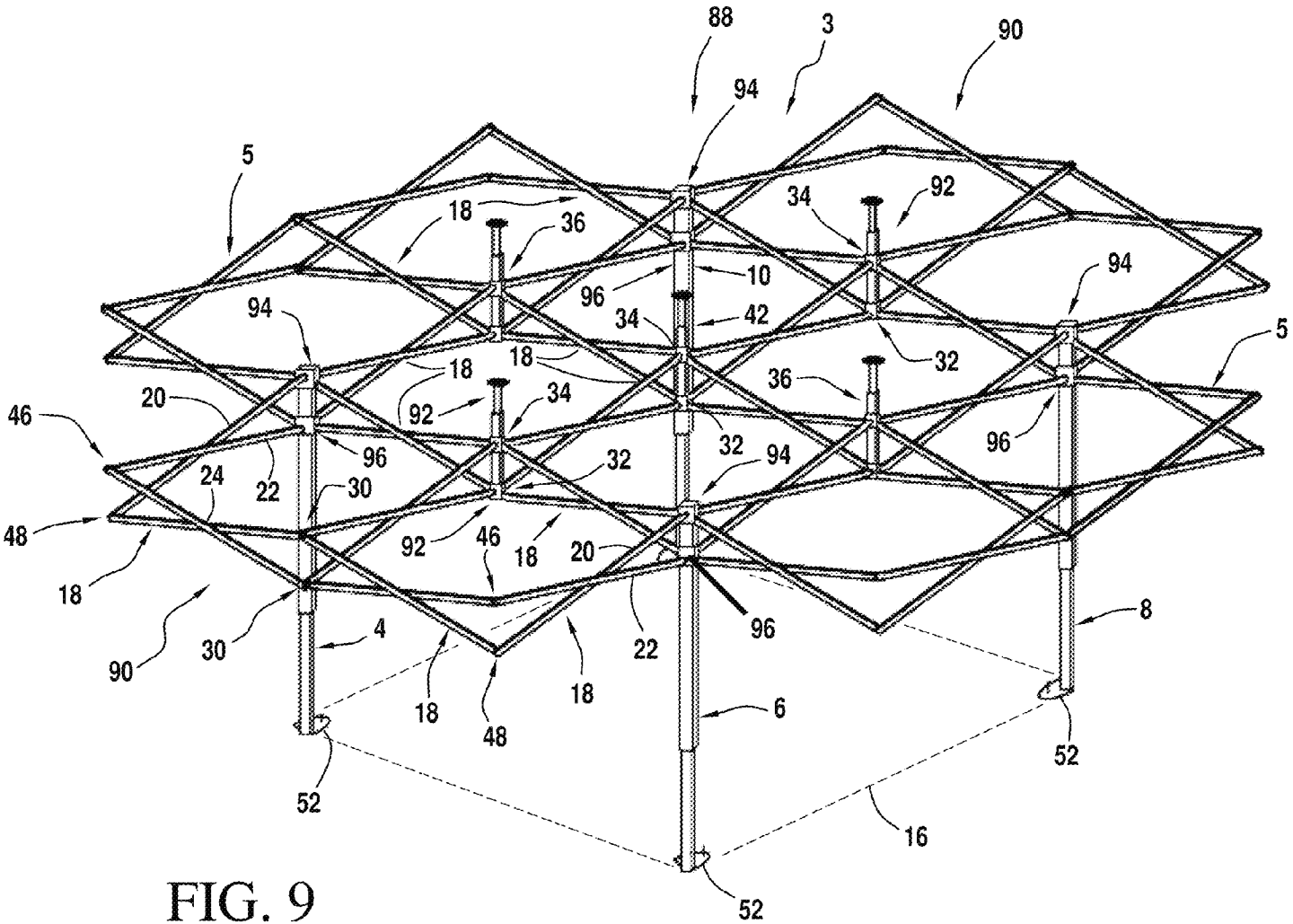
FIG. 9 is a perspective view of another embodiment of a foldable frame with extension frames extending outwardly from the posts on all sides to create overhangs.

Referring to FIG. 9, another embodiment of a foldable frame 88 for a portable canopy is disclosed. The foldable frame 88 is similar to the foldable frame 2 having a main frame 3 and foldable extensions frames 5 at the front and rear side of the main frame 3. Foldable extension frames 90 have been added to the left side and the right side of the main frame 3. The foldable extensions 90 extend the footprint of the main frame 3 beyond the posts 4-6 and the posts 8-10, extending outside the geometric footprint 16. Floating posts 92 have been added between the posts 4 and 6 and the posts 8 and 10. The floating posts 92 extend above the top ends of the posts 4-10 and are preferably on the same level as the other floating posts 36 and 42. When a fabric roof cover is placed on the frame 88, the top surfaces of the posts 36, 42 and 92 would define a horizontal diamond. If the top surfaces of the posts 92 are lower than the tops surfaces of the posts 36 and 42, a different design is created by the roof cover. The floating posts 92 are the same as the floating posts 36 and 42 and secured to the foldable arms 18 by the same brackets 32 and 34.

The foldable extension frames 90 are made up of a number of x-shaped foldable arms 18. The members 20 and 22 of each arm 18 are connected at their midpoints with the pivot 24. The extension frames 90 are attached to the main frame 3 with brackets 94, 96 and brackets 32, 34. The bracket 94 is fixed to the top end of the respective posts 4-10, while the bracket 96 is slidable along the outside surface of the respective posts 4-10 for folding. The outlying foldable arms 18 are connected to each other by brackets 30 and brackets 46, 48.

The floating posts 92 are connected to respective foldable arms 18 with brackets 32 and 34.

Figure 10:
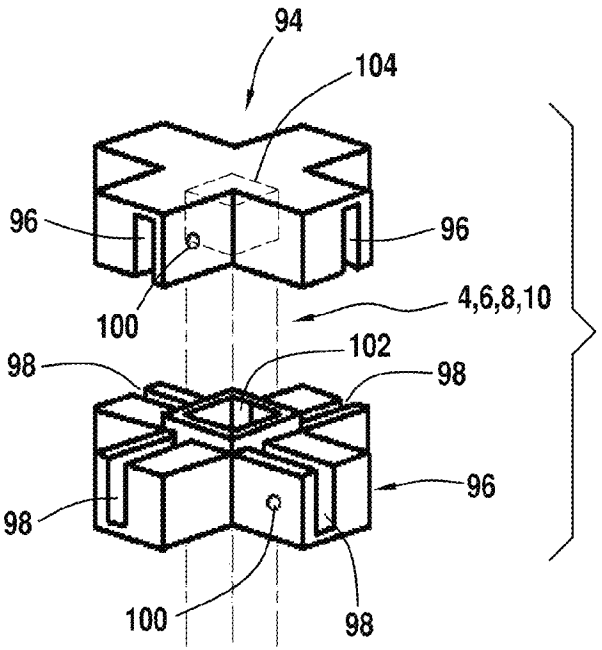
FIG. 10 is a perspective view of an upper fixed bracket and a lower slidable bracket used in the foldable frame of FIG. 9.

Referring to FIG. 10, the brackets 94 and 96 are shown in detail. The bracket 96 includes four slots 98 oriented 90° to each other. The end portions of the members 22 are received within the respective slots 96 with respective pins 100 for pivotal motion of the members 22 during folding and unfolding of the frame 88. The slots 98 are configured for freedom of motion of the members 22 during folding and unfolding. An opening 102 allows the bracket 96 to freely slide up or down the respective posts 4-10 during folding or unfolding of the frame 88. Standard means, such as a removable pin radially disposed in radial holes in the tubular member 14 below the bracket 96 is used to stop the sliding bracket 96 from sliding downwardly when deployed.

The bracket 94 includes similar slots 96 to receive the end portions of the members 20 and attached therein by pins 100 for pivotal motion of the arms during folding and unfolding of the frame 88. A recess 104 receives an end portion of the respective posts 4-10 and fixed therein.

Figure 11:
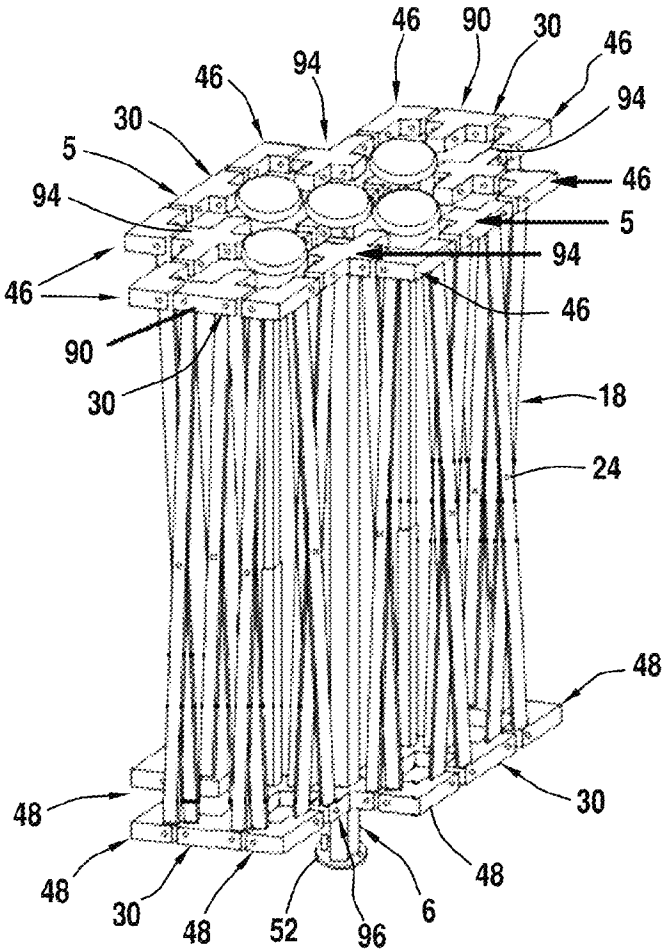
FIG. 11 is a perspective view of the foldable frame of FIG. 9 shown in the folded position.

Referring to FIG. 11, the foldable frame 88 is shown in the folded position. Since all the members 20 and 22 of each arm 18 are of the same length and pivoted at their midpoints, the frame 88 when folded makes the members 20 and 22 to be bunched together, pointing in the same general direction as the posts 4-10 to make a compact bundled package that is small enough to fit in the trunk of a car.

Figure 12:
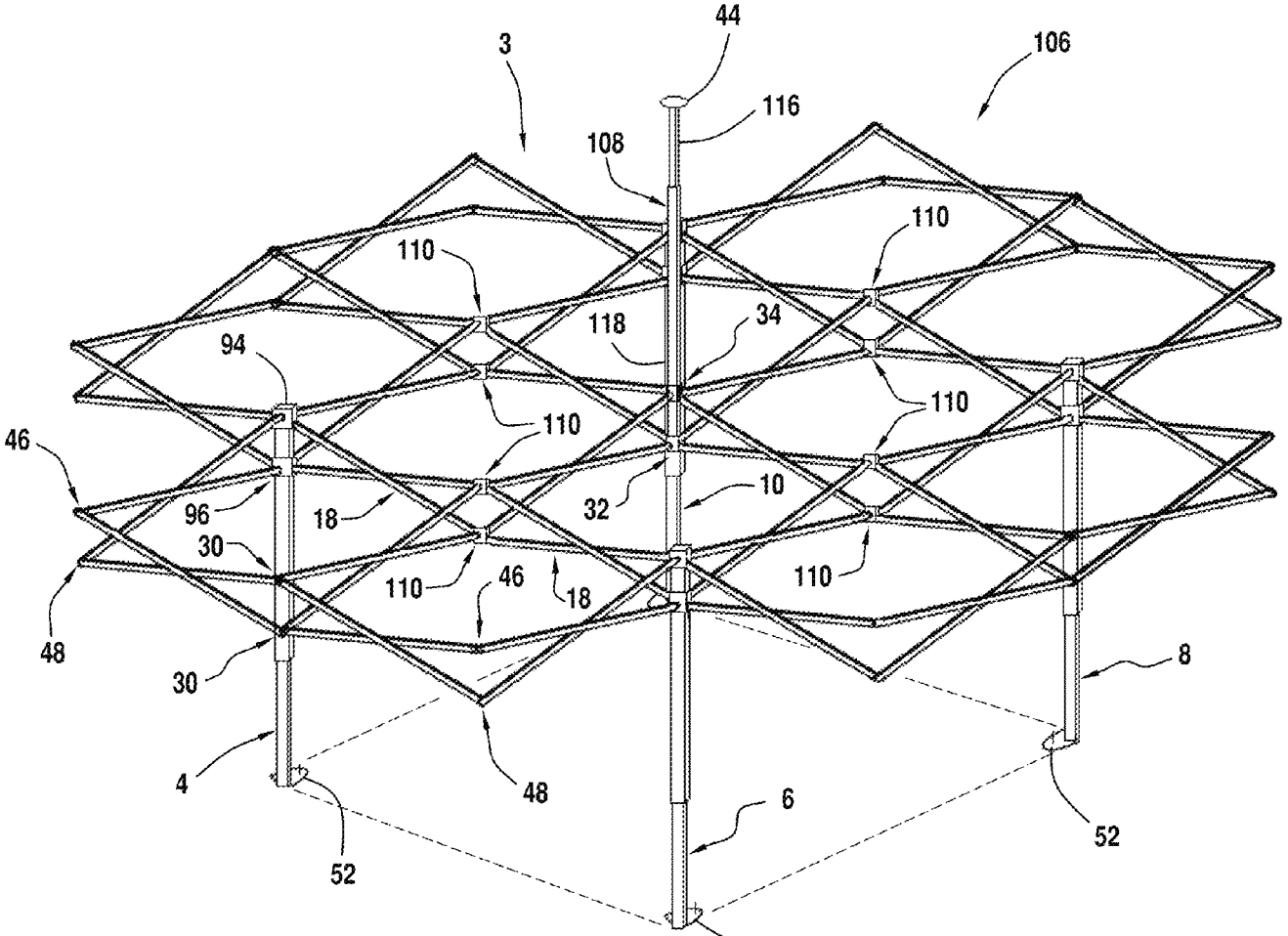
FIG. 12 is a perspective view of another embodiment of a foldable frame for a canopy with a single floating post and extension frames extending outwardly from the posts on all sides to create overhangs.

Referring to FIG. 12, another embodiment of a foldable frame 106 for a portable canopy is disclosed. The foldable frame 106 is similar to the foldable frame 88 in that it includes the main frame 3, the foldable extension frames 5 at the front and rear of the main frame 3, and foldable extension frames 90 at the left and right side of the main frame 3. The floating posts 36 and 92 have been eliminated. The remaining floating post 42 has been modified to a floating post 108, which has been made longer than the floating post 42 so it can rise above the posts 4-10 much higher. The floating post 108 is centrally located over the foldable frame 106. The brackets 94 and 96 and 110 attach the extension frames 5 and 90 to the main frame 3. The brackets 30, 46 and 48 and 110 connect the outlying arms 18 together to form the respective extension frames 5 and 90. Brackets 110 attach the arms 18 between the posts 4-6, 6-8, 8-10 and 10-4 and to the floating post 108 and to the outlying arms 18 of the extension frames 5 and 90.

Figure 13:
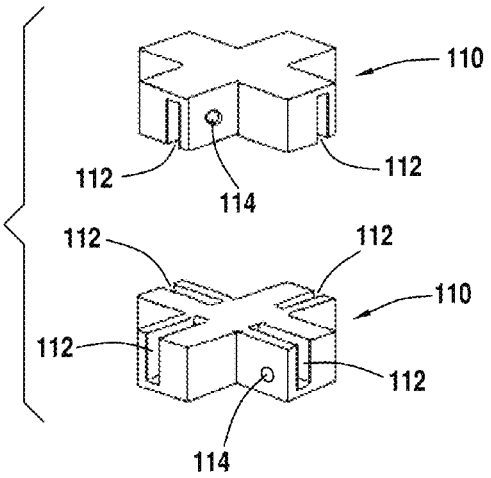
FIG. 13 is perspective view of an upper fixed bracket and a lower slidable bracket used in the foldable frame of FIG. 12.

Referring to FIG. 13, the bracket 110 includes four slots 112 arranged 90° to each other for receiving the end portions of the members 20 and 22. Pins 114, one for each slot 112 (only two visible), pivotally secure the end portions of the members 20 and 22 within the respective slots 112. The slots 112 are configured for freedom of motion of the end portions of the members 20 and 22 during folding and unfolding of the frame 106.

The floating post 108 comprises a tubular member 116 telescopingly received within another tubular member 118. The length of the floating post 108 is adjustable to increase its length to raise the top cap 44 above the top of the posts 4-10 and to shorten its length for folding. When the frame 106 is folded, the length of the floating post 108 is preferably about the same as the length of the arm 20 or 22. Standard means such as pins disposed radially through aligned holes in the tubular members 116 and 118 may be used to secure the tubular members 116 and 118 when extended during use or retracted when folded (see, for example, FIG. 18).

Figure 14:
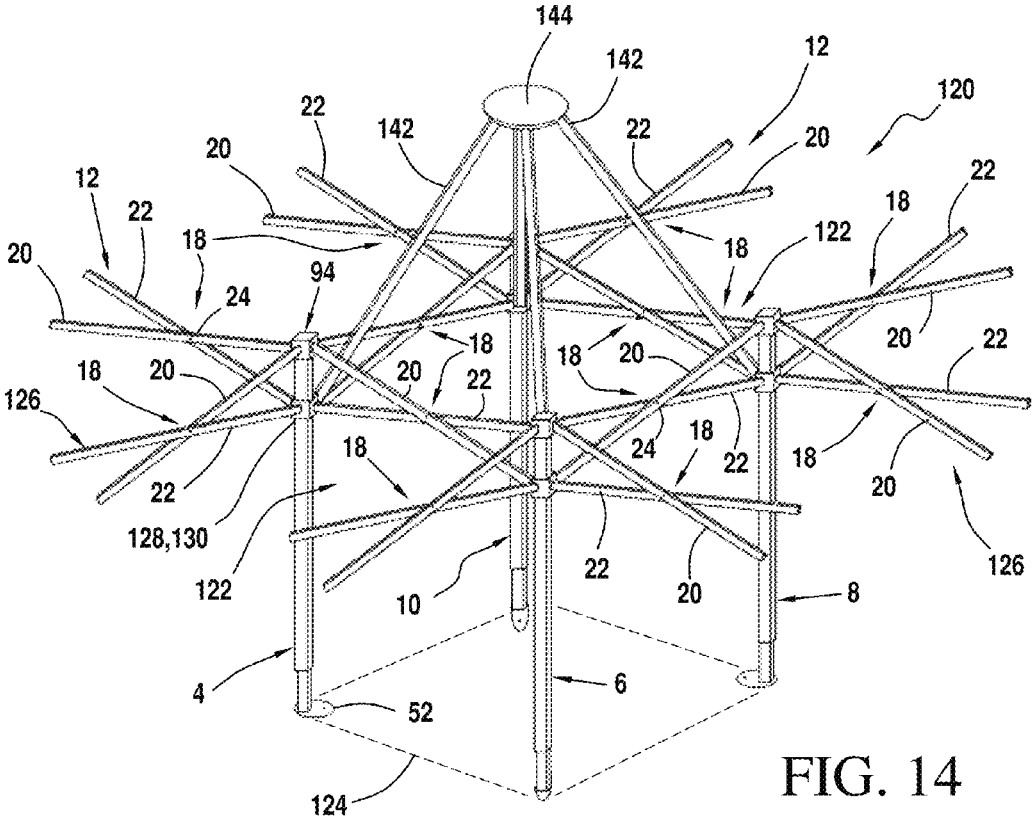
FIG. 14 is another embodiment of a foldable frame using a central raise cap and extension frames extending outwardly from the posts on all sides to create overhangs.

Referring to FIG. 14, another embodiment of a foldable frame 120 for a portable canopy is disclosed. The foldable frame 120 includes a main frame 122 which is coextensive with the geometric footprint 124 defined by the posts 4-10. Foldable extension frames 126 are disposed around the sides of the main frame 122 to extend the reach of the main frame 122 beyond the footprint 124. The extension frames 126 are made up of two x-shaped arms 18 extending outwardly from each post. The outwardly extending arms 18 lie on the same plane as defined by two adjacent posts. Each plane defined by two adjacent posts will contain the two outwardly extending arms 18, in addition to the arm 18 connecting the two adjacent posts. Each post includes two outwardly extending arms 18, each one being about 90° to the other. The members 20 and 22 are attached to the respective post by the brackets 94 and bracket 128 or bracket 130.

Figure 15:
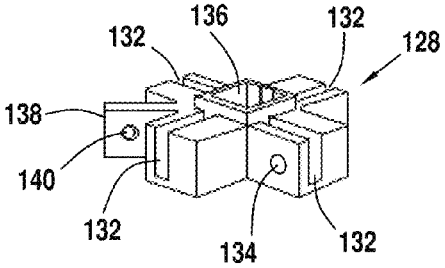
FIG. 15 is perspective view of a lower slidable bracket used in the foldable frame of FIG. 14.

Referring to FIG. 15, the bracket 128 includes four slots 132 disposed 90° to each other for receiving the end portions of the members 20 or 22. Pins 134, one for each slot, are disposed through the respective slots 132 for pivotably securing the end portions of the respective members 20 or 22 in the slots. The slots 132 are configured for freedom of motion of the end portions of the members 20 and 22 for folding and unfolding of the frame 120. An opening 136 allows the respective post to pass therethough in slidable manner during the folding or unfolding of the frame 120. Standard means, such as a removable pin radially disposed in radial holes in the tubular member 14 below the bracket 128 is used to stop the sliding bracket 128 from sliding downwardly when deployed. A plate member 138 with a pin 140 projects from the main body of the bracket 128 at about 45° between two adjacent slots 132. The plate member 138 is used to pivotably secure one end of a supporting arm 142 that holds a top cap 144 that rises above the posts 4-10. Each supporting arm 142 is extendable during deployment and retractable for folding.

Figure 16:
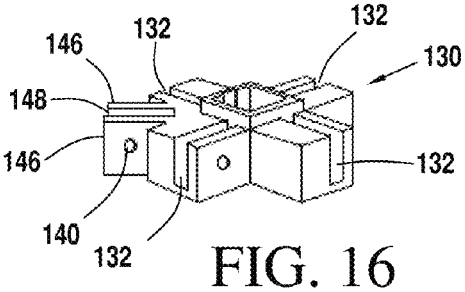
FIG. 16 is a perspective of a modification of the lower slidable bracket of FIG. 15.

Referring to FIG. 16, a bracket 130 is similar to the bracket 128, except that that the plate member 138 is replaced with two parallel plate members 146 with a space 148 between for receiving an end portion of the supporting arms 142. The pin 140 secures the end portion of the supporting arm 142 for pivotable motion within the space 148 during folding and unfolding of the frame 120.

Figure 17:
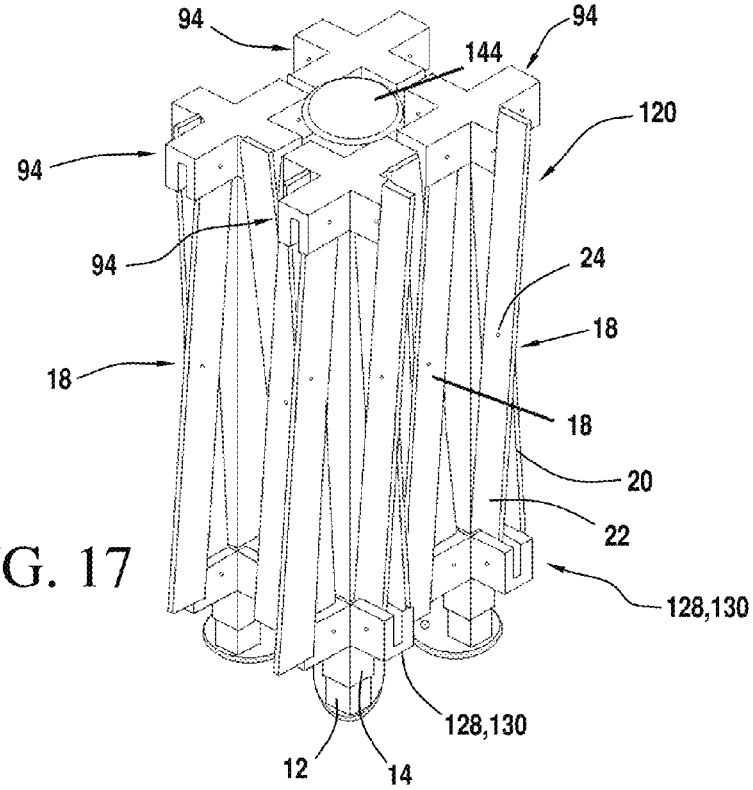
FIG. 17 is a perspective view of the foldable frame of FIG. 14 shown in the folded position.

Referring to FIG. 17, the foldable frame 120 is shown in the folded position when not in use. Since all the members 20 and 22 of each arm 18 are of the same length and pivoted at their midpoints and the supporting arm 142 is adjustable in length to correspond to about the length as the members 20 and 22, the frame 120 when folded places the members 20 and 22 to be bunched together, pointing in the same general direction as the posts 4-10 to make a compact bundled package that is small enough to fit in the trunk of a car.

Figure 18:
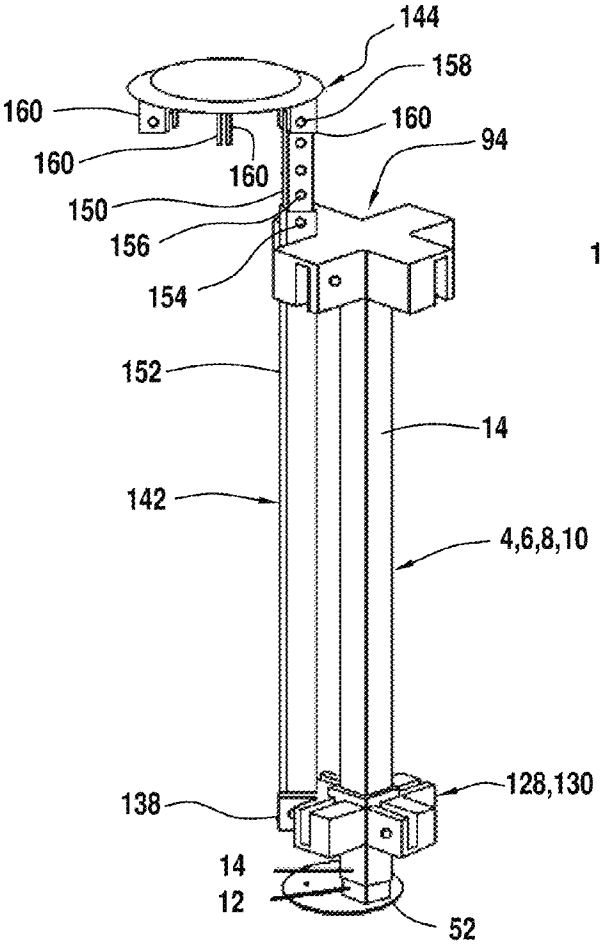
FIG. 18 is a fragmentary perspective view of the floating post used in the foldable frame of FIG. 14 in a partially folded position.

Referring to FIG. 18, the supporting arm 142 is shown in detail. The supporting arm 142 includes a longitudinal member 150 telescopingly received within a tubular member 152. A pin 154 is received within any of the holes 156 through the longitudinal member 150 to adjust the length of the support arm 142. The arm 142 is retracted to about the length of the arm 20 or 22 for folding. The arm 142 is extended during use to raise the top cap 144 above the level of the posts 4-10. The longitudinal member 150 is pivotably attached to the top cap 144 through a pin 158 held by a pair of spaced apart plate members 160 attached to an underside of the top cap 144.

Figure 19:
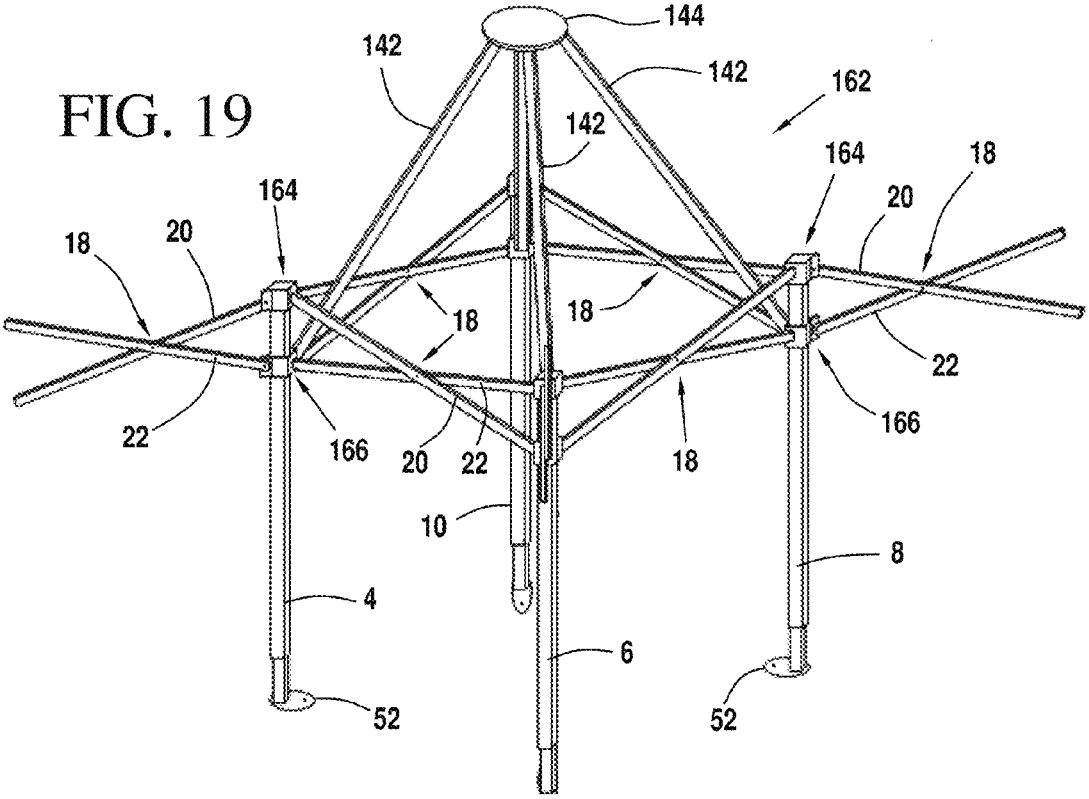
FIG. 19 is another embodiment of a foldable frame for a canopy using a central raised cap and extension frames extending outwardly from the posts on all sides to create overhangs.

Referring to FIG. 19, another embodiment of a foldable frame 162 for a portable canopy is disclosed. The foldable frame 162 is similar to the foldable frame 120 shown in FIG. 14, except that the outlying arms 18 that make up the foldable extension frames 126 have been reduced in number. Instead of having two outlying arms 18 extending from each post, only one arm 18 is used. Each outlying arm 18 extends substantially along the diagonal connecting the post to which the arm 18 is attached and the opposite post. For example, the outlying arm 18 attached to the post 6, the arm 18 substantially extends outwardly along the diagonal connecting the posts 6 and 10.

Figure 20:
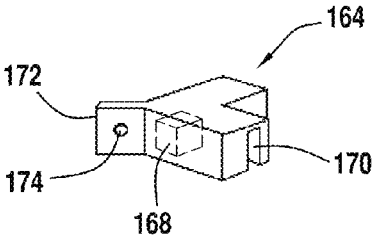
FIG. 20 is a perspective view of an upper fixed bracket used in the foldable frame of FIG. 19.
Figure 21:
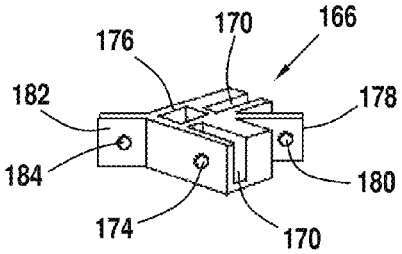
FIG. 21 is a perspective view of a lower slidable bracket used in the foldable frame of FIG. 19.

Referring to FIGS. 20 and 21, upper fixed bracket 164 and sliding bracket 166 are used to attach the x-shaped arms 18 to the respective posts 4-10. The bracket 164 is fixedly attached to the top end of the respective post. A recess 168 receives the top end of the respective post. Two slots 170 oriented 90° to each other receive the end portions of the members 20 and 22. A plate member 172 extends outwardly substantially along a line dividing the 90° separation between the slots 170. The plate member 172 includes a pin 174 for pivotable mounting of the end portion of the arm 20.

Referring to FIG. 21, the bracket 166 includes similar slots 170 and respective pins 174 for pivotably receiving the end portions of the arm members 20 and 22. An opening 176 is configured for passing through the respective posts 4-10 for folding and unfolding of the frame 162. Standard means, such as a removable pin radially disposed in radial holes in the tubular member 14 below the bracket 166 is used to stop the sliding bracket 166 from sliding downwardly when deployed. A plate member 178 with a pin 180 is used to pivotably attach an end portion of the respective supporting arm 142. A plate member 182 extends outwardly opposite to the plate member 178 for pivotable attachment to the end portion of the outlying arm member 22. A pin 184 secures the end portion of the arm member 22 for pivotable motion during folding and unfolding of the frame 162.

Figure 22:
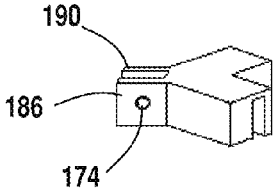
FIG. 22 is a perspective view of a modified version of the upper fixed bracket shown in FIG. 20.
Figure 23:
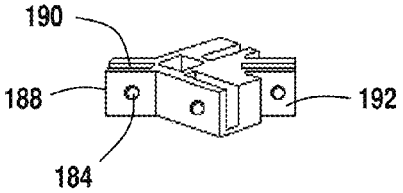
FIG. 23 is a perspective view of a modified version of the lower slidable bracket shown in FIG. 21.

Referring to FIGS. 22 and 23, the construction of the plate members 172 and 182 has been modified to two parallel plate members 186 and 188 with respective spaces 190 between for receiving the end portion of the arm members 20 and 22. The pins 174 and 184 provide for pivotable attachment of the respective arm members 20 and 22. The plate member 178 for the bracket 166 has been modified to two parallel plate members 192 with space 194 for pivotably receiving the end portion of the respective supporting arm 142.

Figure 24:
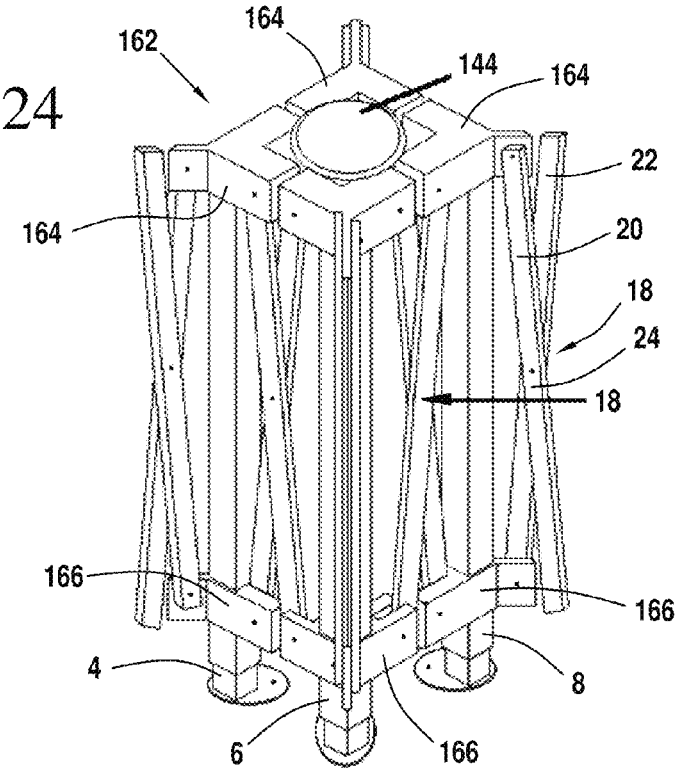
FIG. 24 is a perspective view of the foldable frame of FIG. 19 shown in the folded position.

Referring to FIG. 24, the foldable frame 162 is shown in the folded position. The supporting arms 142 (not visible) have been retracted to about the same length as the arm members 20 and 22. The posts 4-10 have been also been retracted significantly to contribute to a compact bundled package that is small enough to fit in the trunk of a car.

Figure 25:
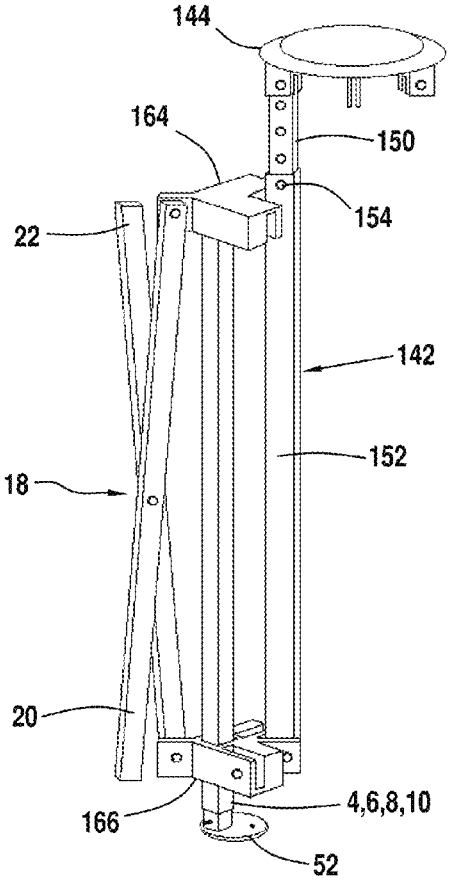
FIG. 25 is a fragmentary perspective view of the foldable frame of FIG. 19 shown with one of the extension frames in the folded position and the floating post is a partially folded position.

Referring to FIG. 25, a partial view of the folded frame 162 is shown to illustrate the retraction of the supporting arm 142 to a shorter length. The pin 154 is removed so as to free the longitudinal member 150 from the tubular member 152 and allow the longitudinal member 150 to retract into the tubular member 152.

Figure 26:
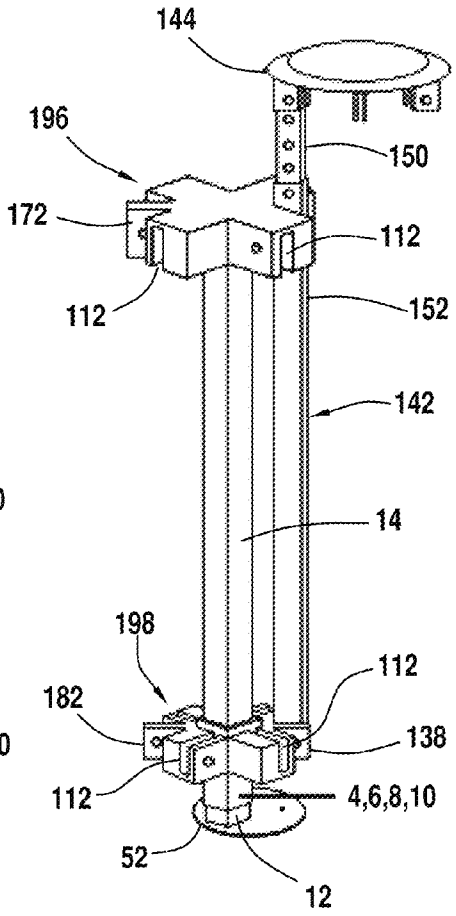
FIG. 26 a fragmentary perspective view of a foldable frame showing an upper fixed bracket and a lower slidable bracket for use in the foldable frame of FIG. 14 or 19.

Referring to FIG. 26, brackets 196 and 198 may also be used for the foldable frame 120 and 162. The bracket 196 includes the four slots 112 for the arms 18 of the main frame 122 and the extension frames 126 of the foldable frame 120. In addition, the bracket 196 includes the plate member 172 for pivotal attachment of the outlying arms 18 of the foldable frame 162. Similarly, the bracket 198 includes the four slots 112 for the arms 18 of the main frame 122 and the extension frames 126 of the foldable frame 120. In addition, the bracket 198 includes the plate member 182 for pivotal attachment of the outlying arms 18 of the foldable frame 162.

It should be understood that the brackets 196 and 198 may also be used for a combination foldable frame that includes the outlying arms 18 of the frames 120 and 162 for additional support for the fabric cover 82 (see FIG. 8) and for a different roof shape.

Figure 27:
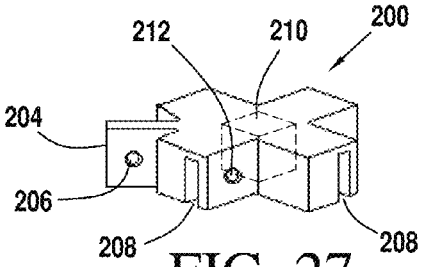
FIG. 27 is a perspective view of an upper fixed bracket shown in FIG. 26.
Figure 28:
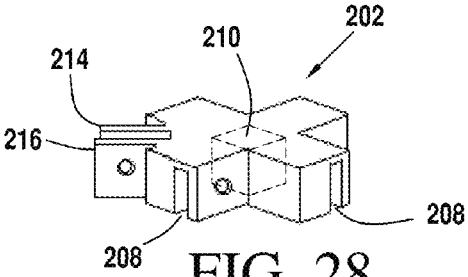
FIG. 28 is a modified version of the upper fixed bracket shown in FIG. 27.

Referring to FIGS. 27 and 28, brackets 200 and 202, in combination with the brackets 128 and 130 (see FIGS. 15 and 16), respectively, may be used for the foldable frame 106 (see FIG. 12) when additional outlying arms 18 as in the manner of the frame 162 (see FIG. 19) are desired. Plate member 204 and pin 206 may be used to pivotably attach an arm member 20 with the plate member 138 on the bracket 128 securing the other arm member 22. Four slots 208 are similar to the slots 132 and are used to pivotably secure the end portions of the respective arm members 20 or 22 with a respective pin. A recess 210 is provided to secure therein an end portion of the respective posts 4-10. Referring to FIG. 28, the plate member 204 of the bracket 200 is replaced with two parallel plate members 212 with a space 216 therebetween for pivotably receiving the end portion of the arm member 20 or 22.

Referring to FIGS. 29 and 30, another embodiment of a supporting arm 216 is disclosed. The supporting arm 216 includes a longitudinal member 218 joined to another longitudinal member 220 with a link 222. A further longitudinal member 224 pivotably attached to the longitudinal member 218 with a pin 226 provides additional support to the support arm 216 during use. The link 222 and the pin 226 allow the supporting arm 216 to be folded with the rest of the foldable frame. The length of the longitudinal members 218 and 220 is advantageously about the same as the length of the x-shaped arm members 20 or 22 to allow for compact folding. The length of the member 224 is advantageously about half the length of the member 218. The pin 226 is located at about the midpoint of the member 218.

Referring again to FIG. 29, bracket 228 is the same as the bracket 200 (see FIG. 27) except for the addition of a plate member 230 to which the end portion of the longitudinal arm 218 is pivotably attached with pin 232.

Referring to FIG. 31, the supporting arm 216 is shown attached to the brackets 164 and 166 used for the foldable frame 162 (see FIG. 19). FIG. 32 shows the supporting arm 216 shown FIG. 31 in the folded position.

Figure 33:
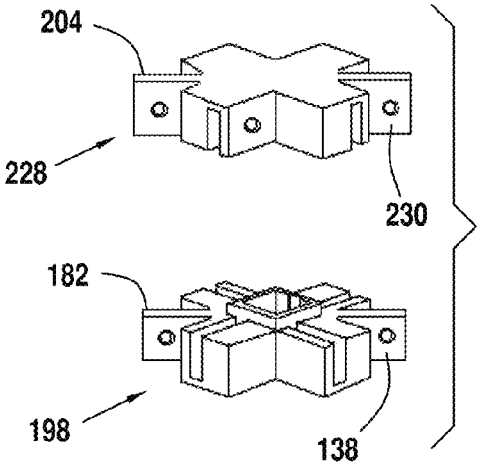
FIG. 33 is a perspective view of an upper fixed bracket and a lower slidable bracket that may be used for the foldable frames of FIGS. 14 and 19.

Referring to FIG. 33, the brackets 228 and 198 are shown in detail. The upper fixed bracket 228 has the same structure as the bracket 200 (see FIG. 27) except for the addition of the plate member 230 (see FIG. 29). Similarly, the lower slidable bracket 198 has the same structure as the bracket 128 (see FIG. 15) except for the addition of the plate member 182.

Figure 34:
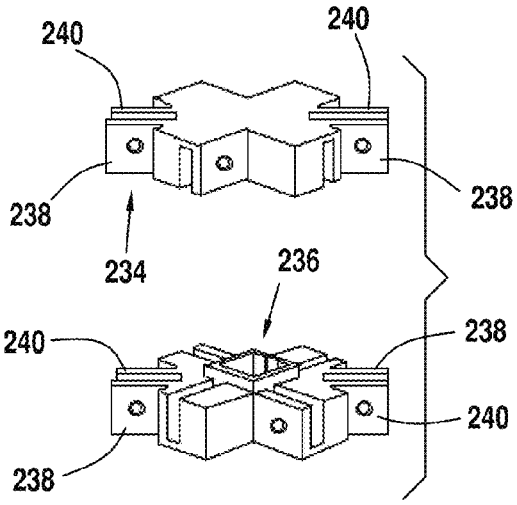
FIG. 34 is a perspective view of modified versions of the upper fixed bracket and the lower slidable bracket of FIG. 33.

Referring to FIG. 34, the brackets 234 and 236 have the same structure as the brackets 228 and 198, respectively, except that the plate members 204, 230, 182 and 138 have been replaced each with two parallel plates 238 with space 240 for receiving the end portions of the arm members 20 and 22 and the longitudinal members 218 and 224 of the supporting arm 216.

Figure 35:
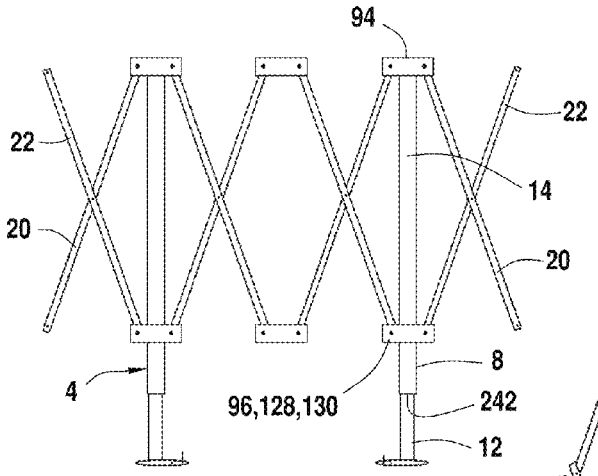
FIGS. 35-38 show various modifications to the extension frames of the foldable frames of FIGS. 14 and 19.

Referring to FIG. 35, a partial view of the folding frame 120 is shown partially folded. The tubular member 14 is slightly longer than the arm member 20 or 22 so that the slidable bracket does not pass beyond the bottom edge 242 of the tubular member 14 when the frame is folded or unfolded. This advantageously avoids the slidable bracket from snagging or being caught in the bottom edge of the tubular member 14.

Figure 36:
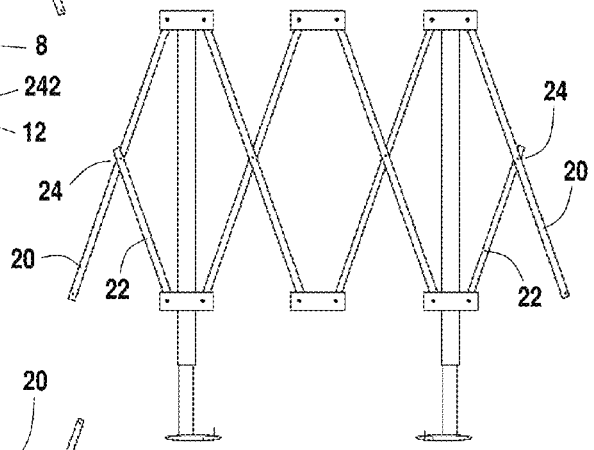
Figure 37:
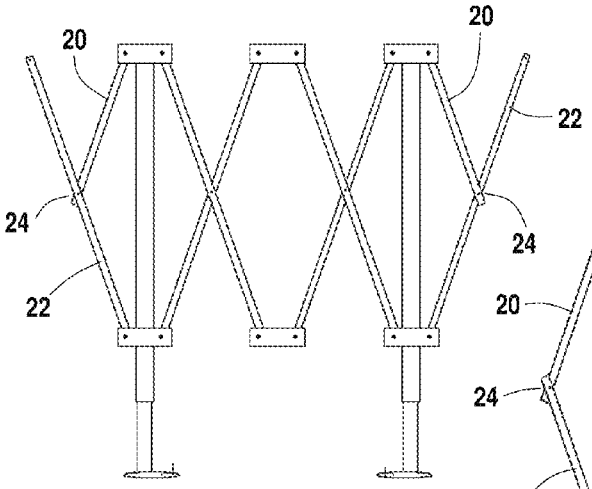
Figure 38:
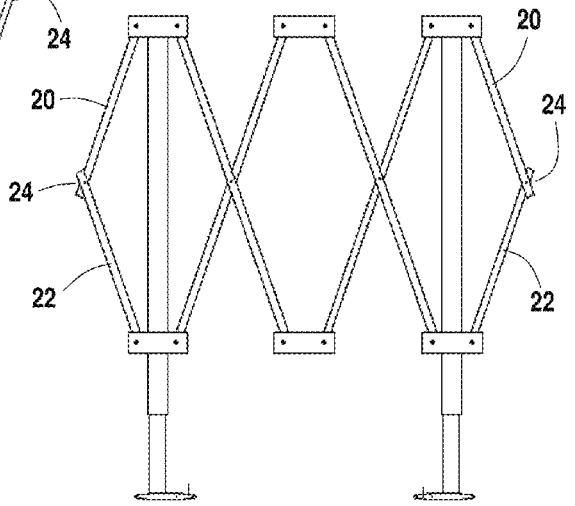

Referring to FIGS. 36-38, various embodiments of the extension arm members 20 and 22 shown in FIG. 35 are disclosed. In FIG. 36, the lower member 22 is shown cut-off after the pivot 24. In FIG. 37, the upper arm member 20 is cut off after the pivot 24. In FIG. 38, both arm members 20 and 22 are cut off after the pivot 24.

Figure 39:
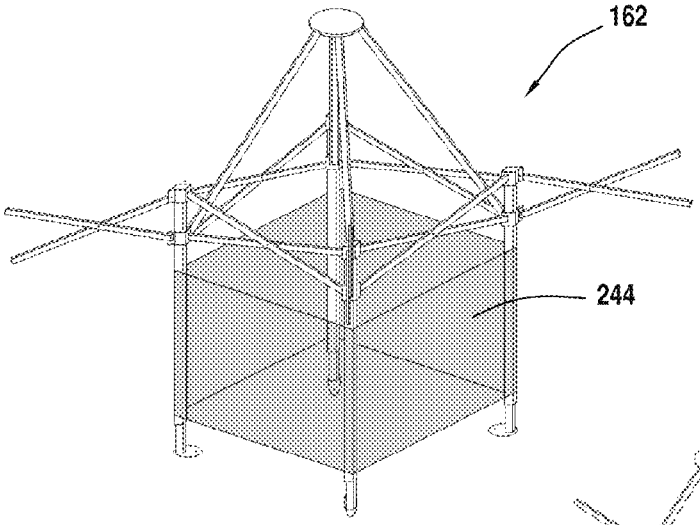
FIGS. 39-41 show various additional uses for the foldable frames of the present invention equipped with a canopy.

Referring to FIG. 39, the foldable frame 162 is used as a shower stall with the addition of sidewalls 244 made of fabric or some suitable material. A suitable cover 246 (see FIG. 41) made of fabric, plastic or other standard materials is supported by the frame 162 to provide a suitable cover from above.

Figure 40:
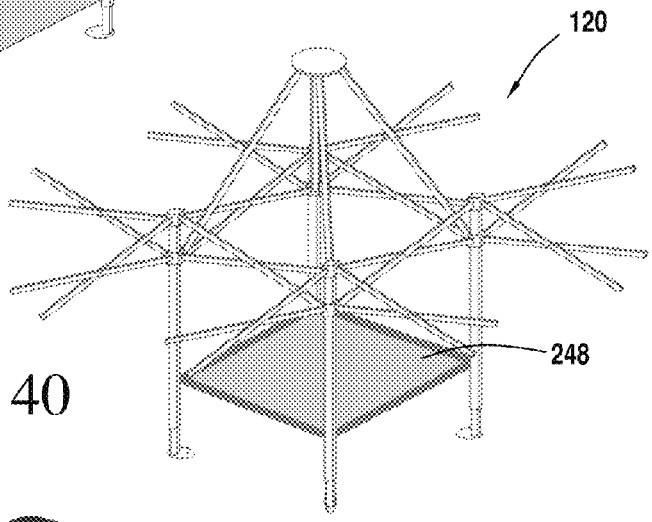

Referring to FIG. 40, the foldable frame 120 is shown with a tabletop 248. A top cover (not shown) will be supported by the frame.

Figure 41:
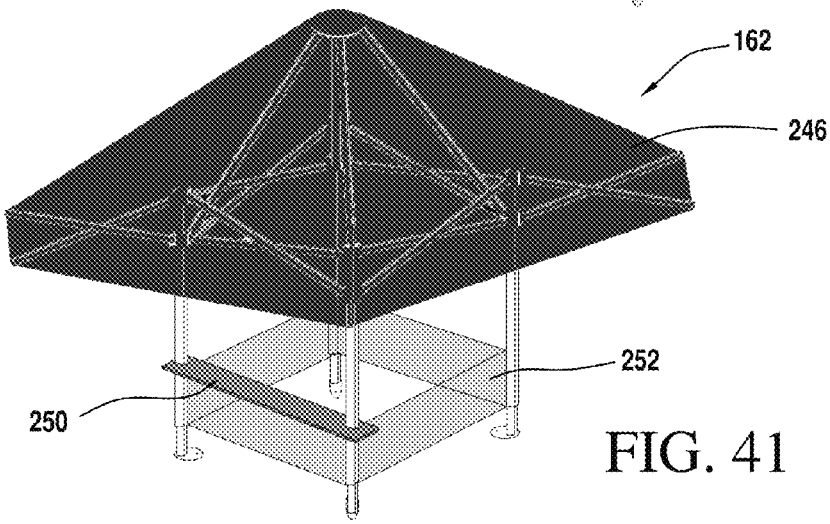

Referring to FIG. 41, the frame 162 is used as a booth with counter space 250 and sidewalls 252. A cover 246 is show supported by the frame 162.

Figure 42:
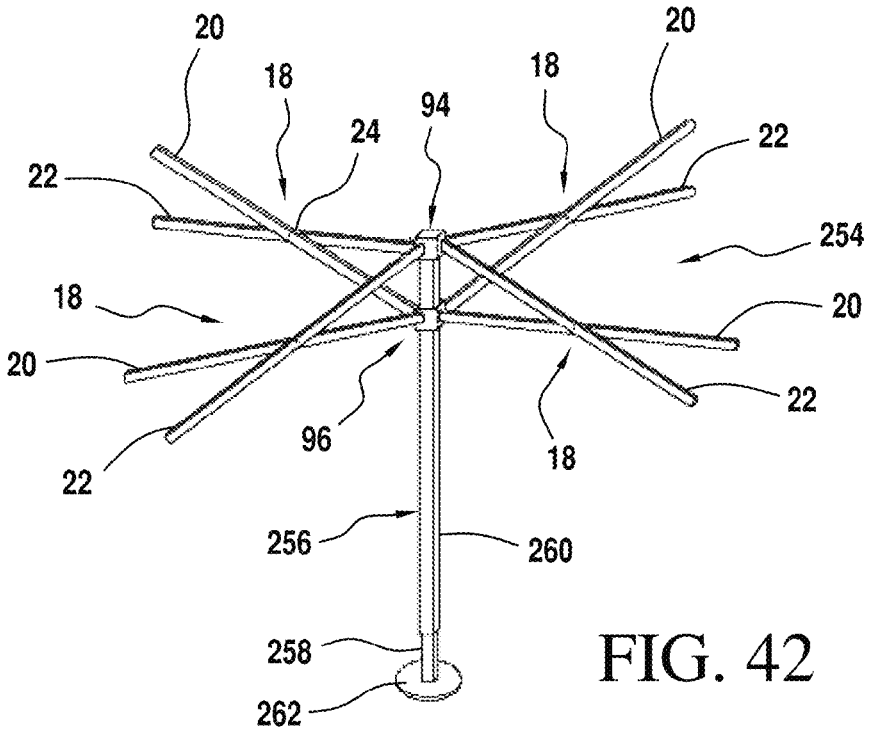
FIG. 42 is a perspective view of another embodiment of a foldable frame for a portable canopy.
Figure 43:
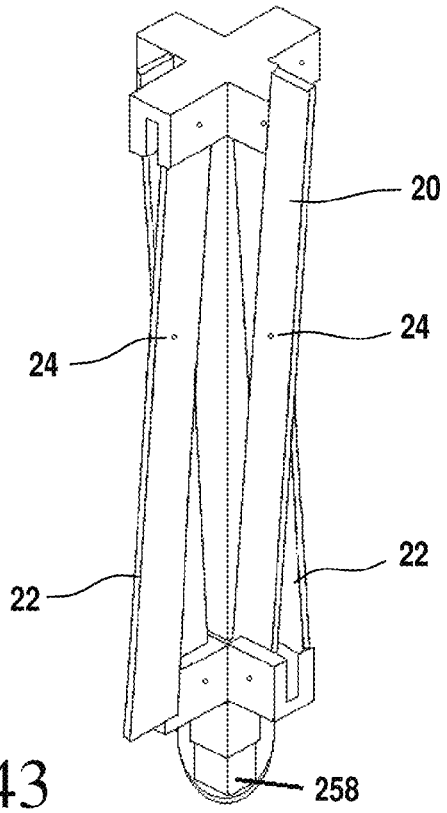
FIG. 43 is a perspective view of the portable frame of FIG. 42 shown in the folded position.

Referring to FIG. 42, another embodiment of a foldable frame 254 for a portable canopy is disclosed. The foldable frame 254 uses a single telescoping post 256 with an inner tubular member 258 telescopingly received with an outer tubular member 260, whereby the post 256 may be axially extended or retracted for reducing or extending the length of the post. The post 256 is locked in the desired length with standard means, such as a removable pin radially disposed through the overlapping portions of the tubular members 258 and 260 in cooperating holes. The post 256 is supported on the ground with a base 262.

A plurality of the arms 18 are supported from the post 256 with the upper fixed bracket 94 and the lower slidable bracket 96, shown in detail in FIG. 10. Each arm 18 is made up of the equal length longitudinal members 20 and 22 pivoted at their midpoints with the pivot 24. The frame 254 when deployed would be supported in vertical position with standard means, such as using a table and disposing the post 256 through the center of the table and using a weighted base for the base 262.

The post 256 is retracted to a smaller length when the frame 254 is folded. The frame 254 when folded places the members 20 and 22 to be bunched together, pointing in the same general direction as the post 256 to make a compact bundled package that is small enough to fit in the trunk of a car.

A portable canopy as disclosed herein comprises a foldable frame and cover that can be folded into a compact package for transport and storage and that can be easily erected and collapsed in a few minutes is disclosed above. A plurality of telescoping support posts connected to each other by a plurality of X-shaped arms made up of longitudinal members of equal length advantageously provides for folding into a compact bundled package. A flexible fabric or similar material covers the entire frame. Uses of the folding frames as disclosed herein are numerous, limited only by the user's imagination.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A foldable frame for a portable canopy, comprising:

a) first, second, third and fourth posts for being supported vertically on the ground, said posts are extendable and retractable in length, said posts defining a geometric footprint on the ground;

b) at least one arm operably attached to and between adjacent of said first, second, third and fourth posts;

c) said at least one arm forming a main frame within said geometric footprint;

d) said foldable frame including a deployed position wherein said posts are extended and said at least one arm is transverse to respective said posts;

e) said foldable frame including a folded position wherein said posts are retracted, and said posts and said at least one arm are bunched together and oriented in a general same direction; and f) a base attached to a bottom end of each of said posts, a bar removably and pivotably attached to said base, said bar being removable from said base while said base is stationary, said bar being pivotable relative to said base while remaining transverse relative to respective said posts when said posts are vertical and stationary on the ground such that said bar is positionable for being underneath a respective tire of a vehicle when parked within said foldable frame when said foldable frame is in said deployed position.

2. A foldable frame as in claim 1, wherein said at least one arm includes an upper end and a lower end, said upper end being pivotably attached to an upper end of respective said posts, said lower end being pivotably and slidably attached to respective said posts below said upper end of respective said posts.

3. A foldable frame as in claim 2, wherein:

a) at least another arm extends outwardly from each of said posts to form at least first and second extension frames extending beyond said geometric footprint, said main frame and said at least first and second extension frames for supporting a cover of said portable canopy;

b) said at least one arm and said at least another arm each includes first and second longitudinal members; and c) said first and second longitudinal members are pivotably attached to each other at a midpoint of each longitudinal member.

4. A foldable frame as in claim 2, wherein:

a) each of said posts includes an upper fixed bracket pivotably attached to said upper end of said at least one arm; and b) each of said posts includes a lower slidable bracket pivotably attached to said lower end of said at least one arm.

5. A foldable frame as in claim 4, wherein:

a) said at least one arm includes first and second longitudinal members;

b) said first and second longitudinal members are pivotably attached to each other at a midpoint of each longitudinal member;

c) said fixed bracket includes at least one recess for receiving an end portion of said first longitudinal member;

d) said slidable bracket includes at least one recess for receiving an end portion of said second longitudinal member; and e) said slidable bracket includes an opening for passing through respective said posts in sliding motion during folding and unfolding of said foldable frame.

6. A foldable frame as in claim 5, wherein said at least one recess of said fixed bracket and said slidable bracket includes at least first and second recesses oriented 90° to each other.

7. A foldable frame as in claim 1, wherein said at least one arm includes first and second arms pivotably joined together end-to-end.

8. A foldable frame as in claim 7, and further comprising a first floating post operably supported from said first and second arms.

9. A foldable frame as in claim 8, wherein:

a) said first floating post is disposed centrally of said geometric footprint; and b) a plurality of support arms pivotably attached to said first floating post and respective junction between said first and second arms.

10. A foldable frame as in claim 9, and further comprising:

a) a second floating post attached to a junction between said first and second arms attached to said first and fourth posts on the ground; and b) a third floating post attached to a junction between said first and second arms attached to said second and third posts on the ground.

11. A foldable frame as in claim 10, wherein said first, second and third floating posts include respective top ends disposed at a same level above said posts on the ground.

12. A foldable frame for a portable canopy, comprising:

a) first, second, third and fourth posts for being supported vertically on the ground, said posts defining a geometric footprint on the ground;

b) at least one arm operably attached to and between adjacent posts of said first, second, third and fourth posts;

c) said at least one arm forming a main frame within said geometric footprint;

d) first and second arms disposed transversely to each other and extending outwardly from each of said posts to form extension frames extending beyond said geometric footprint, said first arm including a distal end, said second arm including a distal end, said distal end of said first arm on one post being unattached to said distal end of said first arm and said distal end of said second arm on an adjacent post adjacent said one post, said distal end of said second arm on said one post being unattached to said distal end of said first arm and said distal end of said second arm on another adjacent post adjacent to said one post, said main frame and said extension frames for supporting a cover of said portable canopy;

e) a floating post operably supported from said at least one arm above the ground;

f) said first, second, third and fourth posts and said floating post each including a tubular member and another member telescopingly received with said tubular member such that each of said first, second, third and fourth posts and said floating post are extendable and retractable in length;

g) said at least one arm including first and second longitudinal members pivotably attached to each other at a midpoint of each longitudinal member, said first and second longitudinal members are equal in length;

h) said foldable frame including a deployed position wherein said first, second, third and fourth posts and said floating post are extended and said at least one arm is transverse to respective said posts;

i) said foldable frame including a folded position wherein said first, second, third and fourth posts and said floating post are retracted, and said first, second, third and fourth posts and said floating post, said at least one arm and said first and second arms are bunched together and oriented in a general same direction;

j) each of said at least one arm and said first and second arms including an upper end and a lower end, said upper end of said at least one arm and said first and second arms being pivotably attached to an upper end of respective said posts, said lower end of said at least one arm and said first and second arms being pivotably and slidably attached to respective said posts below said upper end of respective said posts;

k) each of said first, second, third and fourth posts including an upper fixed bracket pivotably attached to said upper end of each of said at least one arm and said first and second arms;

l) each of said first, second, third and fourth posts including a lower slidable bracket pivotably attached to said lower end of each of said at least one arm and said first and second arms;

m) said floating post including a lower fixed bracket and an upper slidable bracket;

n) said upper fixed bracket of said first, second, third and fourth posts and said lower fixed bracket of said floating post including first, second, third and fourth recesses oriented 90° between adjacent recesses; and o) said lower slidable bracket of said first, second, third and fourth posts and said upper slidable bracket of said floating post including first, second, third and fourth recesses oriented 90° between adjacent recesses.

13. A foldable frame as in claim 12, wherein:

a) said first and second arms each includes third and fourth longitudinal members pivotably attached to each other at a midpoint of each longitudinal member; and b) said third and fourth members are equal in length.

14. A foldable frame as in claim 12, wherein:

a) said first and second arms each includes third and fourth longitudinal members; and b) distal ends of said third and fourth longitudinal members are pivotably connected.

15. A foldable frame as in claim 12, wherein:

a) said first and second arms each includes third and fourth longitudinal members; and b) a distal end of said third longitudinal member is pivotably attached to a midpoint of said fourth longitudinal member.

16. A foldable frame for a portable canopy, comprising:

a) first, second, third and fourth posts for being supported vertically on the ground, said posts are extendable and retractable in length, said posts defining a geometric footprint on the ground;

b) at least one arm operably attached to and between adjacent posts of said first, second, third and fourth posts;

c) said at least one arm forming a main frame within said geometric footprint;

d) first and second arms disposed transverse to each other and extending outwardly from each of said posts to form extension frames extending beyond said geometric footprint, said first arm including a distal end, said second arm including a distal end, said distal end of said first arm said distal end of said first arm on one post being unattached to said distal end of said first arm and said distal end of said second arm on an adjacent post adjacent to said one post, said distal end of said second arm on said one post being unattached to said distal end of said first arm and said distal end of said second arm on another adjacent post adjacent to said one post, said main frame and said extension frames for supporting a cover of said portable canopy;

e) a cap;

f) a plurality of telescoping arms;

g) each telescoping arm including a lower end pivotably and slidably attached to respective said posts and an upper end pivotably attached to said cap;

h) said foldable frame including a deployed position wherein said posts are extended, said at least one arm and said first and second arms are transverse to respective said posts and said cap is disposed above the ground;

i) said foldable frame including a folded position wherein said posts and said telescoping arms are retracted, and said posts, said telescoping arms, said at least one arm and said first and second arms are bunched together and oriented in a general same direction;

j) said at least one arm and said first and second arms each including an upper end and a lower end, said upper end of said at least one arm and said first and second arms being pivotably attached to an upper end of respective said posts, said lower end of said at least one arm and said first and second arms being pivotably and slidably attached to respective said posts below said upper end of respective said posts;

k) each of said first, second, third and fourth posts including an upper fixed bracket pivotably attached to respective said upper end of said at least one arm and said first and second arms;

l) each of said first, second, third and fourth posts including a lower slidable bracket pivotably attached to respective said lower end of said at least one arm and said first and second arms;

m) said fixed bracket including first, second, third and fourth recesses oriented 90° between each other, said upper end of said at least one arm and said upper end of each of said first and second arms are disposed in respective said first, second, third and fourth recesses of said fixed bracket, n) said slidable bracket including first, second, third and fourth recesses oriented 90° between each other, said lower end said at least one arm and said lower end of each of said first and second arms are disposed in respective said first, second, third and fourth recesses of said slidable bracket; and o) said slidable bracket including a fifth recess, said lower end of said telescoping arm is pivotably received in said fifth recess.

17. A foldable frame as in claim 16, wherein:

a) said first and second arms each includes first and second longitudinal members pivotably attached to each other at a midpoint of each longitudinal member, said first and second members are equal in length; and b) said telescoping arms when retracted are about the same length as said first and second longitudinal members.

18. A foldable frame as in claim 17, wherein:

a) said first and second arms each includes third and fourth longitudinal members; and b) distal ends of said third and fourth longitudinal members are pivotably connected.

19. A foldable frame as in claim 17, wherein a) said first and second arms each includes third and fourth longitudinal members; and b) a distal end of said third longitudinal member is pivotably attached to a midpoint of said fourth longitudinal member.

20. A foldable frame for a portable canopy, comprising:

a) first, second, third and fourth posts for being supported vertically on the ground, said posts are extendable and retractable in length, said posts defining a geometric footprint on the ground;

b) at least one arm operably attached to and between adjacent of said first, second, third and fourth posts;

c) said at least one arm forming a main frame within said geometric footprint, said main frame for supporting a cover of said portable canopy;

d) first and second arms extending outwardly from each of said posts to form extension frames extending beyond said geometric footprint, said first arm including a distal end, said second arm including a distal end, said distal end of said first arm on one post being unattached to said distal end of said first arm and said distal end of said second arm on an adjacent post adjacent to said one post, said distal end of said second arm on said one post being unattached to said distal end of said first arm and said distal end of said second arm on another adjacent post adjacent to said one post, said main frame and said extension frames for supporting said cover of said portable canopy;

e) a cap;

f) a plurality of supporting arms, each of said supporting arms being operably connected to said cap and respective said posts;

g) each of said supporting arms including first, second and third longitudinal members, said first and second longitudinal members are pivotably joined together end-to-end, a free end of said first longitudinal member is pivotably connected to a fixed bracket on an upper end of respective said post, a free end of said second longitudinal member is pivotably connected to said cap, one end of said third longitudinal member is pivotably connected to a midpoint of said first longitudinal member, an opposite end of said third longitudinal member is pivotably connected to a sliding bracket disposed below said fixed bracket on respective said post;

h) said foldable frame including a deployed position wherein said posts are extended, said at least one arm is transverse to respective said posts and said cap is disposed above said posts;

i) said foldable frame including a folded position wherein said posts are retracted and said supporting arms are folded, and said posts, said at least one arm, said first and second arms and said first, second and third longitudinal members are bunched together and oriented in a general same direction;

j) said at least one arm and said first and second arms each including an upper end and a lower end, said upper end of said at least one arm and said first and second arms being pivotably attached to said fixed bracket of respective said posts, said lower end of said at least one arm and said first and second arms being pivotably and slidably attached to said slidable bracket of respective said posts;

k) said fixed bracket including first and second recesses oriented 90° between each other and a first member disposed between said first and second recesses; and l) said slidable bracket including first and second recesses oriented 90° between each other and a first member disposed between said first and second recesses.

* * * * *